United States Patent [19]

Cohen

[11] 4,309,784

[45] Jan. 12, 1982

[54] PILLOW-DISPLAY CASE

[76] Inventor: Patrice Cohen, 100-5 DeKruif Pl., Bronx, N.Y. 10475

[21] Appl. No.: 157,560

[22] Filed: Jun. 9, 1980

[51] Int. Cl.[3] ..... A47G 9/00

[52] U.S. Cl. ..... 5/442; 5/490; 40/10 D; 206/45.34; 206/457; D6/201

[58] Field of Search ..... 5/434, 436, 441, 490, 5/442, 482, 491; 297/462; 40/10 D, 586; 206/45.34, 457; D6/201, 202, 203

[56] References Cited

U.S. PATENT DOCUMENTS

| | | | |
|---|---|---|---|
| 1,876,591 | 9/1932 | Bawden | 5/490 |
| 3,055,133 | 9/1962 | Anderson | 40/586 |
| 4,091,481 | 5/1978 | Redman | 5/434 |
| 4,108,227 | 8/1978 | Bonner | 40/10 D |
| 4,227,270 | 10/1980 | Rivera | 5/490 |

FOREIGN PATENT DOCUMENTS

| | | | |
|---|---|---|---|
| 1344036 | 1/1974 | United Kingdom | 5/434 |

*Primary Examiner*—Alexander Grosz
*Attorney, Agent, or Firm*—Nathaniel Altman

[57] ABSTRACT

A pillow-display case for housing and displaying various objects such as mementos, collections of small items and the like is disclosed. The pillow is of conventional construction, and has a transparent flexible overlay sheet covering a substantial portion of, and attached at its peripheral edges to, at least one face of the pillow. The space thus created between the transparent sheet and the pillow's face constitutes a display pocket, with reclosable pocket access means provided for introducing, arranging and removing the objects to be displayed.

4 Claims, 8 Drawing Figures

PILLOW-DISPLAY CASE

BACKGROUND OF THE INVENTION

This invention relates to pillows, more specifically to the decorative type commonly referred to as "throw" pillows. It is a principal object of this invention to provide, with this kind of pillow as a base, a combination pillow-display case for accommodating objects of sentimental interest, intrinsic value or visual attractiveness, thus enhancing the usefulness as well as the appearance of such pillows.

SUMMARY OF THE INVENTION

In a preferred form of this invention, a transparent flexible sheet overlay, covering a substantial portion of one face of a pillow of conventional construction, is attached along its peripheral edges to the pillow. The display pocket thus created has reclosable pocket access means for inserting, arranging, mounting and removing the objects to be displayed.

Other embodiments of the invention include: transparent overlays covering both faces of a pillow so that two display pockets permit selectively changeable viewing; multiple display pockets on one face of the pillow; variations in the size and shape of the transparent overlay for creating visual interest; and variations in the nature and location of the pocket access means, which may include a zipper, snaps, hook and loop type strips such as the ones sold under the trademark of Velcro ® or the like.

These and other aspects of the invention will be described in fuller detail in conjunction with the accompanying illustrative drawings, wherein:

SHORT DESCRIPTION OF DRAWINGS

DESCRIPTION OF THE PREFERRED EMBODIMENTS

Figure 1:
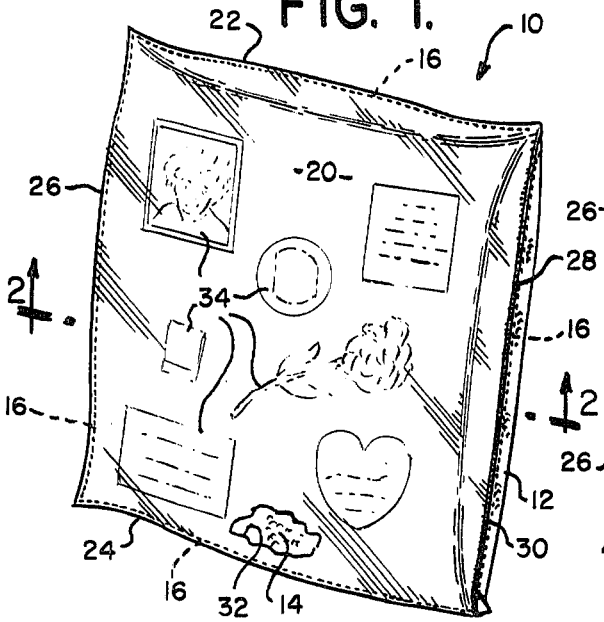
FIG. 1 is a perspective view showing a preferred embodiment of a pillow-display case constructed in accordance with this invention.
Figure 2:
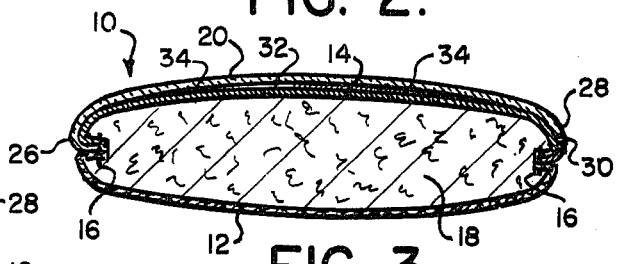
FIG. 2 is a cross-sectional view taken along line 2—2 of FIG. 1.

FIGS. 1 and 2 illustrate pillow-display case 10 constructed in a conventional manner from back panel 12 and front panel 14 sewn together at their edges by blind stitching 16 and holding pillow stuffing material 18 therebetween. Transparent overlay sheet 20 (preferably heavy plastic) is shown in FIG. 1 to be substantially coextensive with front panel 14 and sewn with the same stitching 16 to top edge 22, bottom edge 24 and left edge 26 of pillow 10. Right edge 28 of overlay sheet 20 is attached to zipper 30 which in turn is held by seam stitching 16.

Zipper 30 provides access to the space or display pocket 32 between front pillow panel 14 for introducing, arranging, mounting (by pinning, taping or the like, if desired), or removing display objects 34. Pillow 10 thus constitutes in essence a portable display case for a wide variety of memorabilia and items of decorative or collective value. It may be noted that pillow back and front panels 12 and 14, respectively, may be fabricated from any suitable material, (velvet or felt preferred) either matching or contrasting, and the color and texture of front panel 14 may be selected for their effect as background for display objects 34.

Figure 3:
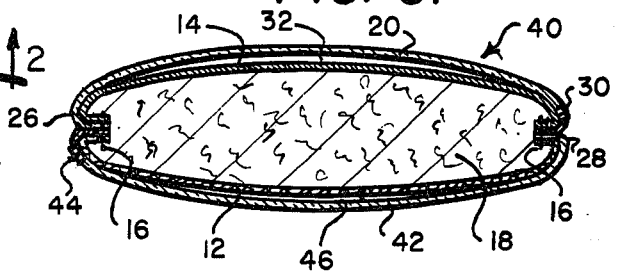
FIG. 3 is a cross-sectional view similar to FIG. 2, but of an alternate embodiment of a display pillow.

In FIG. 3, pillow 40 differs from pillow 10 in having a second flexible transparent overlay 42 coextensive with back pillow panel 12, with second zipper 44 to create a second accessible display pocket 46. Pillow 40 is therefore completely reversible, and two displays may be placed therein for alternative viewing.

Figure 4:
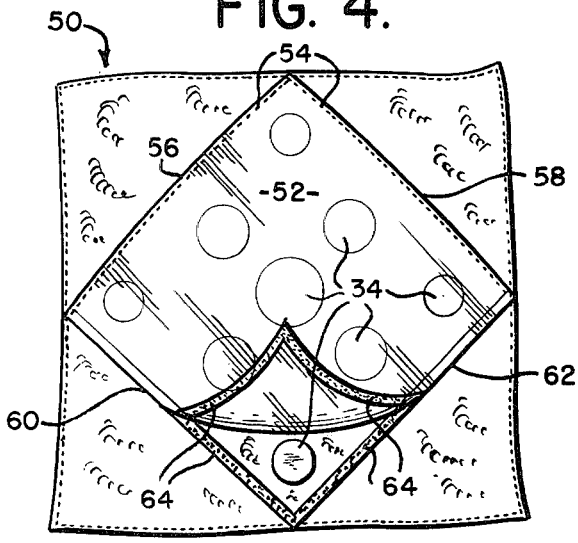
FIG. 4 is a front elevational view of another embodiment of the display pillow.

Pillow 50 of FIG. 4 has transparent overlay sheet 52 not coextensive with, but attached to, front panel 14 by independent stitching 54 along edges 56 and 58. Edges 60 and 62 are joined releasably to front panel 14 by hook and loop stripping 64, which provides access to display pocket 66 for manipulating display objects 34. This embodiment provides the opportunity to make overlay sheet 52 of any desired shape, as for example, a Valentine heart.

Figure 5:
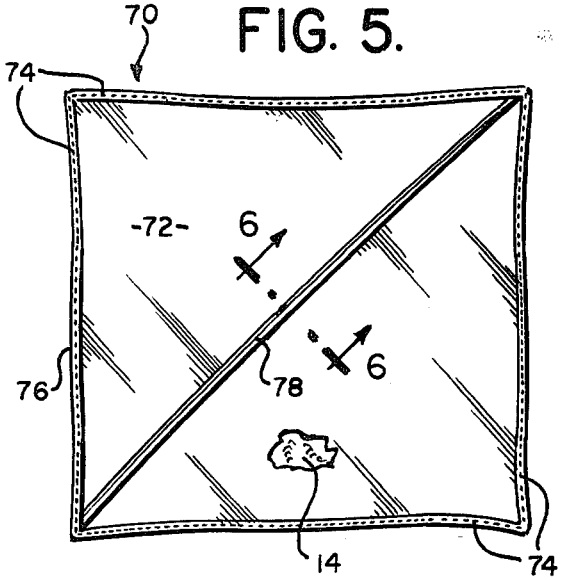
FIG. 5 is a front elevational view of still another alternate example of a display pillow.
Figure 6:
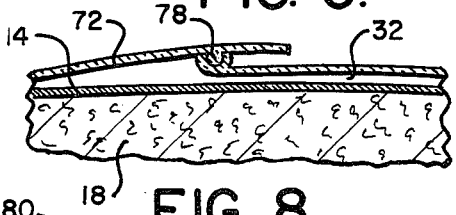
FIG. 6 is a fragmentary enlarged sectional view taken along line 6—6 of FIG. 5.

FIGS. 5 and 6 illustrate another version of this invention with pillow 70 having transparent overlay sheet 72 coextensive with front panel 14 and attached by stitching 74 and binding 76 on all edges. Stitching 74 may be replaced by other attachment means, such as, for example, heat-sealing. Here access means 78 is a elongate strip closure of known type integral with, and extending diagonally across, overlay sheet 72.

Figure 7:
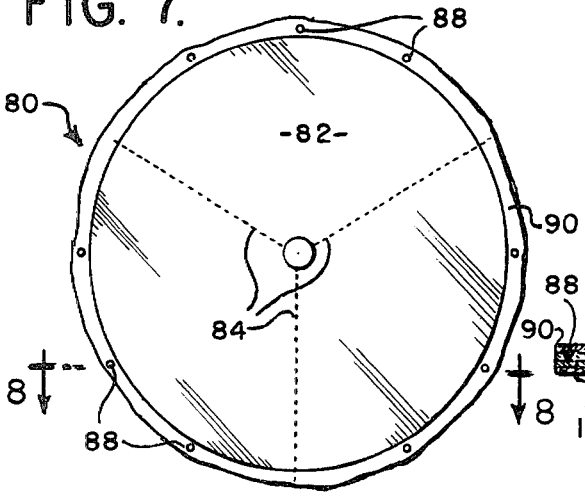
FIG. 7 is a front elevational view of a further display pillow embodiment.
Figure 8:
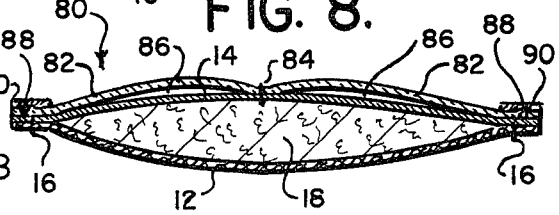
FIG. 8 is a sectional view taken along line 8—8 of FIG. 7

Pillow 80 of FIGS. 7 and 8 is generally round in shape and utilizes a transparent overlay sheet 82 attached to front panel 14 by radially extending stitching 84, thus forming multiple display pockets 86. Access means to these pockets is here illustrated as conventional snaps 88 arranged around the circumferential edge of pillow 80 on tape 90.

It should be noted that the embodiments described above are intended to be illustrative of the best modes for practising this invention now contemplated. Various combinations and substitutions of elements which fall within the spirit of the concepts described herein are anticipated and are limited only by the scope of the ensuing claims.

I claim:

1. Combination pillow-display case for housing and displaying a variety of objects wherein the pillow is of conventional construction comprising a front face panel, the peripheral edges of which are connected to the peripheral edges of a rear face panel, enclosing therebetween suitable pillow-stuffing material, which comprises:

transparent flexible overlay sheet means substantially coextensive with at least one face panel of the pillow, the peripheral edges of said overlay sheet means being attached to the pillow so that at least one normally closed display space is formed between said overlay sheet means and the face panel of the pillow which said overlay sheet means overlays; and reclosable display space access means for opening said normally closed display space to permit the insertion, arrangement, mounting and removal of the objects to be displayed in the combination pillow-display case.

2. Combination pillow-display case in accordance with claim 1, wherein said transparent overlay sheet means is coextensive with both pillow face panels so that said display spaces are formed on both faces of the pillow.

3. Combination pillow-display case in accordance with claim 1, which further comprises means for subdividing said at least one normally closed display space into a plurality of normally closed display spaces, said transparent overlay means being selectively attached to the corresponding pillow face panel, at least one of said reclosable display space access means being provided for each of said plurality of normally closed display spaces.

4. Combination pillow-display case as in claim 1, wherein said reclosable display access space means is a zipper adjacent to and along the peripheral edge of the pillow, said zipper being attached between the pillow and the peripheral edge of said transparent overlay means.

* * * * *